US009756996B1

(12) United States Patent
Ruiz

(10) Patent No.: US 9,756,996 B1
(45) Date of Patent: Sep. 12, 2017

(54) VENTILATED TOILET SEAT

(71) Applicant: Hernaldo Ruiz, Las Cruces, NM (US)

(72) Inventor: Hernaldo Ruiz, Las Cruces, NM (US)

( * ) Notice: Subject to any disclaimer, the term of this patent is extended or adjusted under 35 U.S.C. 154(b) by 18 days.

(21) Appl. No.: 15/019,141

(22) Filed: Feb. 9, 2016

(51) Int. Cl.
*A47K 13/30* (2006.01)
*E03D 9/05* (2006.01)

(52) U.S. Cl.
CPC ..... *A47K 13/307* (2013.01); *E03D 9/05* (2013.01)

(58) Field of Classification Search
CPC ..... A47K 13/30; A47K 13/307; E03D 9/04; E03D 9/05; E03D 9/052
USPC ..... 4/213, 217
See application file for complete search history.

(56) References Cited

U.S. PATENT DOCUMENTS 3,916,459 A * 11/1975 Ivancevic ..... E03D 9/052 4/213
D338,712 S 8/1993 Schaldenbrand
6,055,677 A * 5/2000 McKinley ..... E03D 9/05 4/217
6,363,542 B1 4/2002 Pope, Sr.
7,337,476 B2 3/2008 Green
2002/0032923 A1* 3/2002 Prisco ..... E03D 9/05 4/213
2005/0138720 A1* 6/2005 Shim ..... E03D 9/052 4/213
2006/0085898 A1 4/2006 Rosa
2007/0186334 A1 8/2007 Carter
2009/0229045 A1 9/2009 Ramos
2012/0255110 A1 10/2012 Kao
2014/0201893 A1* 7/2014 Cassaro ..... E03D 9/052 4/217
2017/0014009 A1* 1/2017 Smith ..... A47K 13/307

FOREIGN PATENT DOCUMENTS

WO WO8700879 2/1987

* cited by examiner

*Primary Examiner* — J. Casimer Jacyna
(74) *Attorney, Agent, or Firm* — Kyle A. Fletcher, Esq.

(57) ABSTRACT

The ventilated toilet seat is a toilet seat with built in ventilation holes and channels. Gases accumulating within a toilet basin are collected within the ventilation holes and channels and are routed to an exhaust duct. Ideally, the exhaust duct is vacated using a fan. The ventilated toilet seat comprises a toilet seat, a plurality of ventilation holes and channels, a first seat hinge, a second seat hinge, a first lid hinge, a second lid hinge, a main seat exhaust, a first exhaust tube, a second exhaust tube, an end cap, and an elbow joint.

12 Claims, 5 Drawing Sheets

VENTILATED TOILET SEAT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of flushing devices and related accessories, more specifically a toilet seat.

SUMMARY OF INVENTION

The ventilated toilet seat is a toilet seat with built in ventilation holes and channels. Gases accumulating within a toilet basin are collected within the ventilation holes and channels and are routed to an exhaust duct. Ideally, the exhaust duct is vacated using a fan.

These together with additional objects, features and advantages of the ventilated toilet seat will be readily apparent to those of ordinary skill in the art upon reading the following detailed description of the presently preferred, but nonetheless illustrative, embodiments when taken in conjunction with the accompanying drawings.

In this respect, before explaining the current embodiments of the ventilated toilet seat in detail, it is to be understood that the ventilated toilet seat is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the ventilated toilet seat.

It is therefore important that the claims be regarded as including such equivalent construction insofar as they do not depart from the spirit and scope of the ventilated toilet seat. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
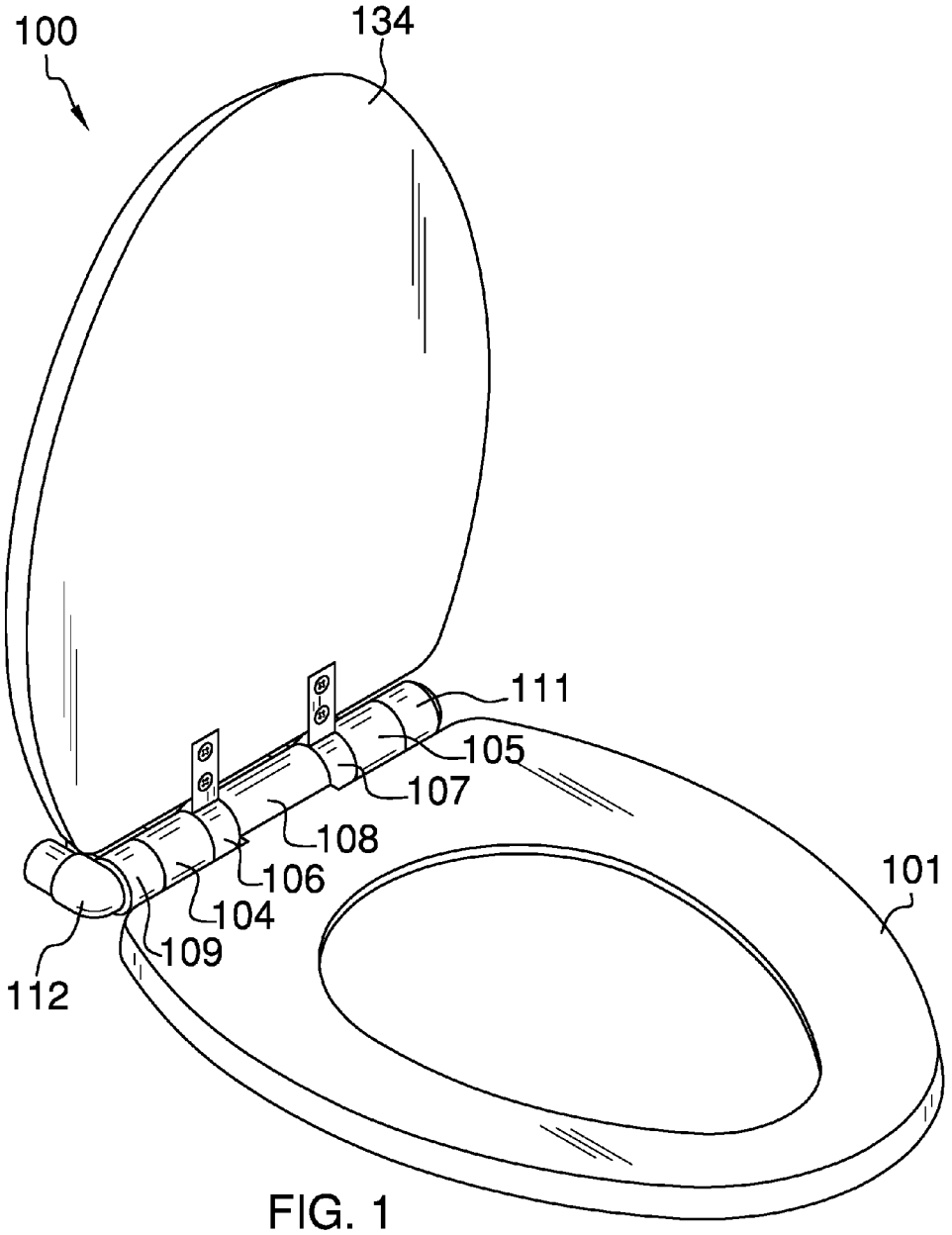
FIG. 1 is a perspective view of an embodiment of the disclosure.
Figure 2:
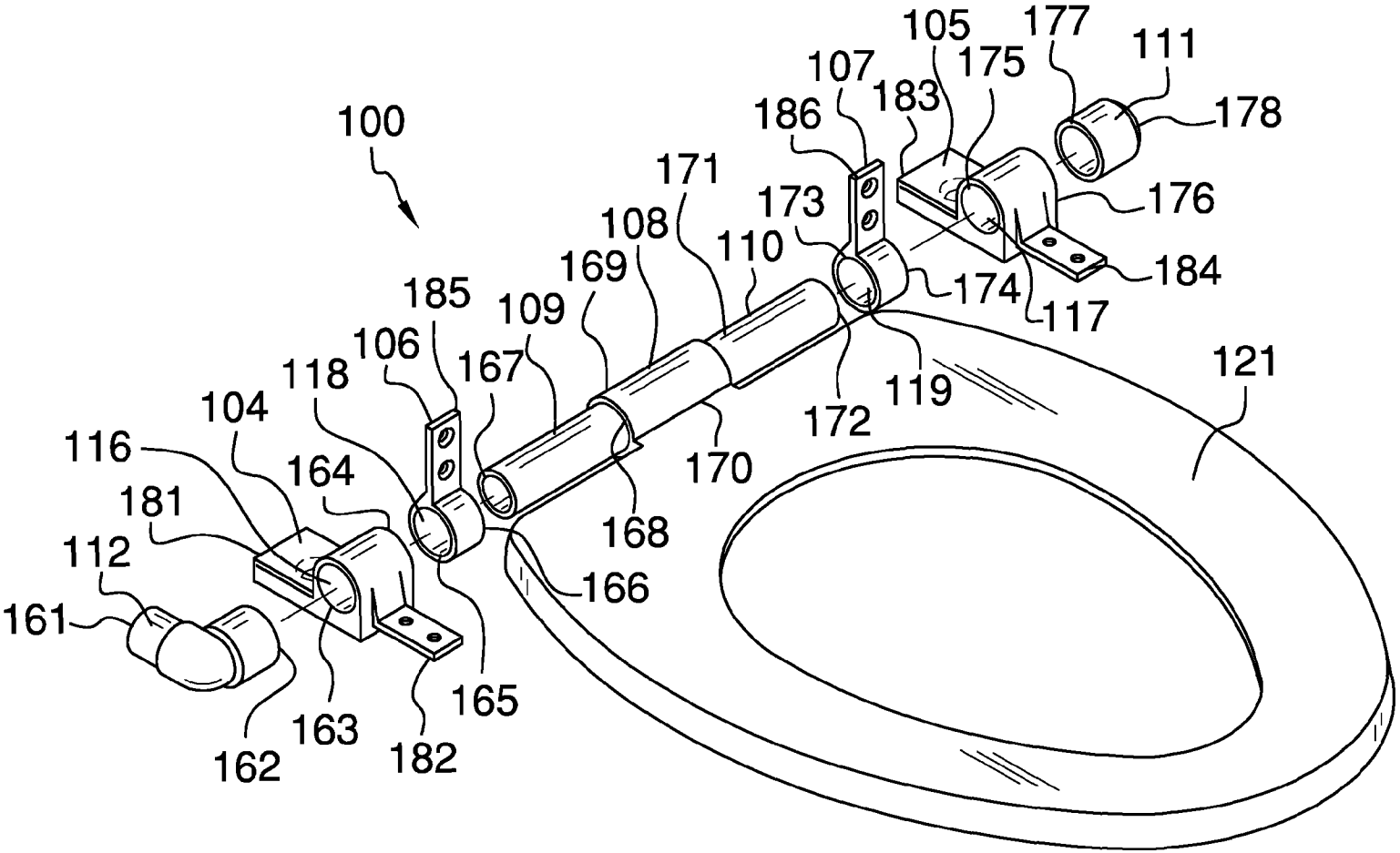
FIG. 2 is an exploded perspective view of an embodiment of the disclosure.
Figure 3:
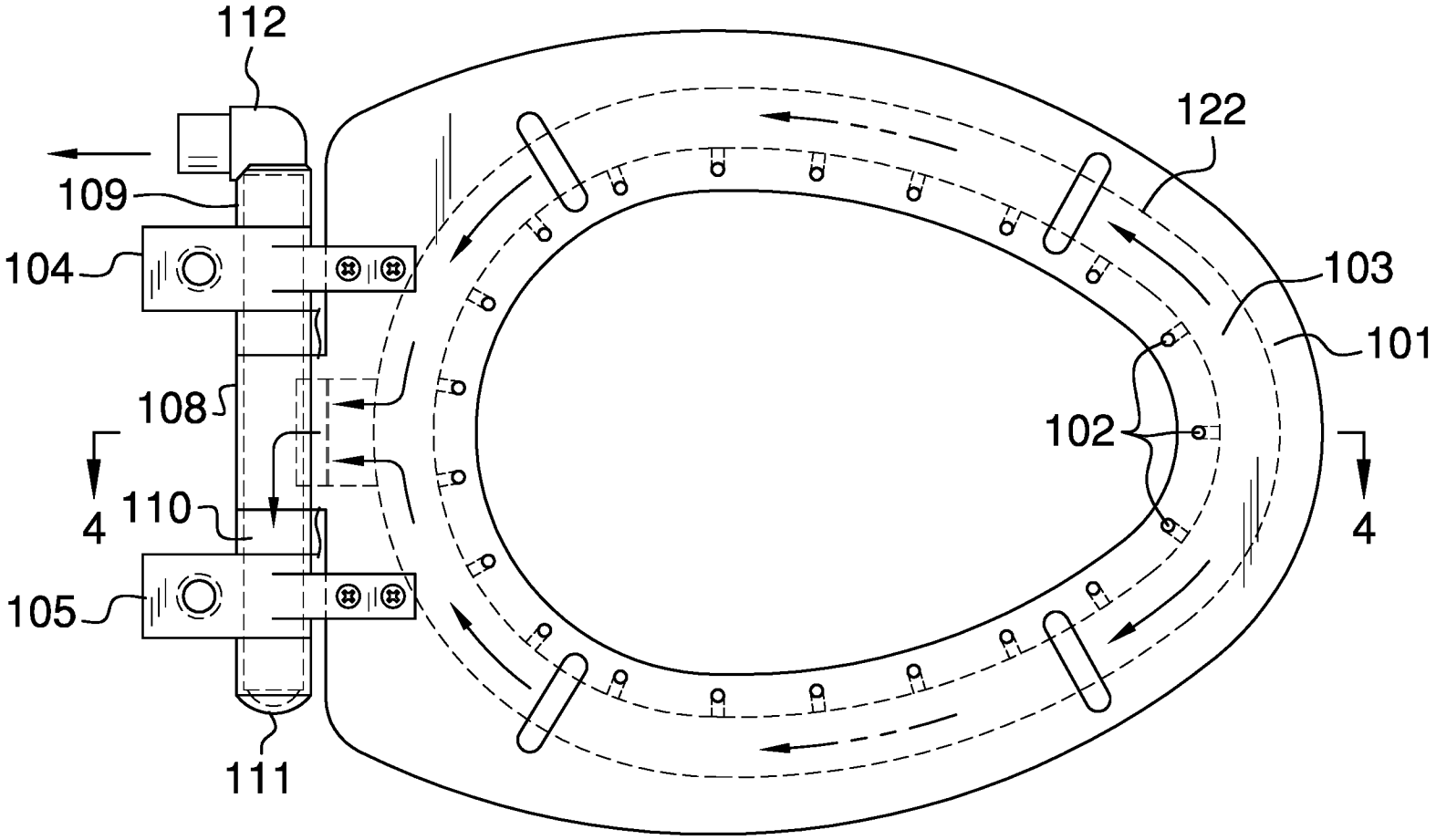
FIG. 3 is a bottom view of an embodiment of the disclosure.
Figure 4:
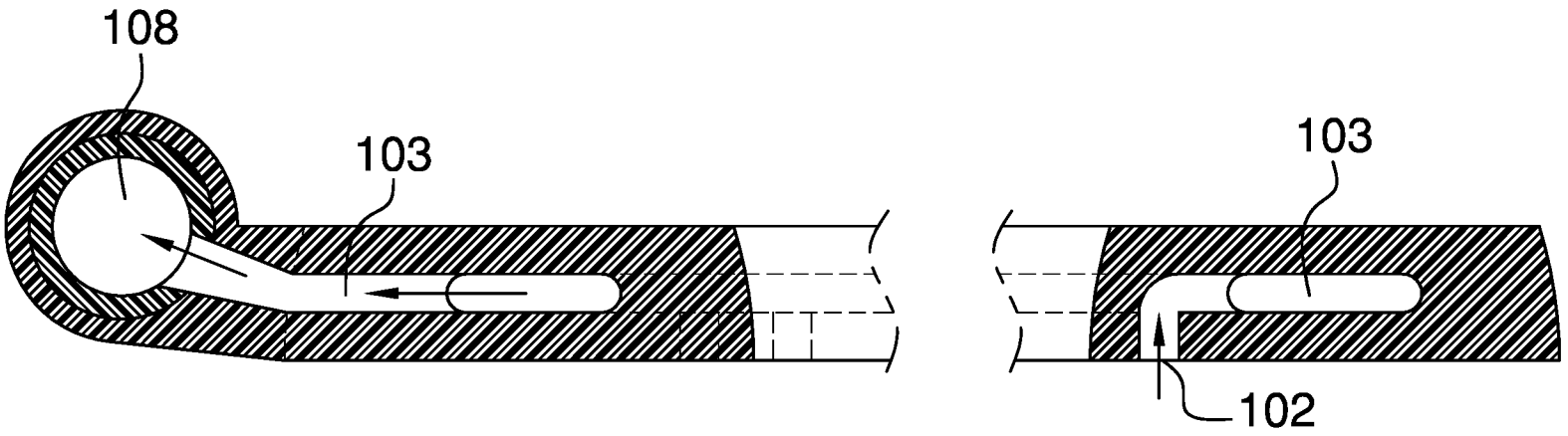
FIG. 4 is a cross-sectional view of an embodiment of the disclosure across 4-4 in FIG. 3.
Figure 5:
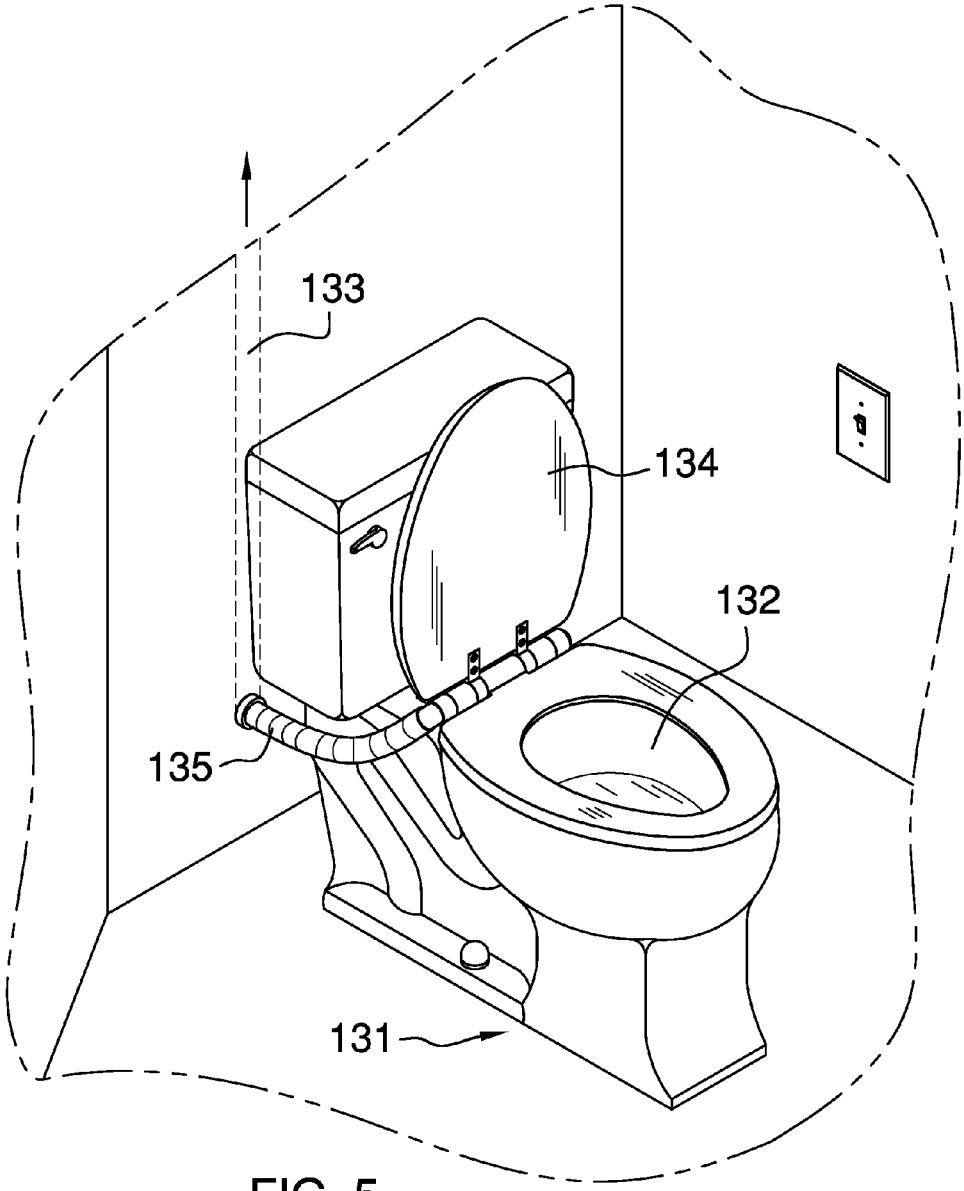
FIG. 5 is an in use view of an embodiment of the disclosure.

Detailed reference will now be made to a first potential embodiment of the disclosure, which is illustrated in FIGS. 1 through 5.

The ventilated toilet seat 100 (hereinafter invention) comprises a toilet seat 101, a plurality of ventilation holes 102, one or more ventilation channels 103, a first seat hinge 104, a second seat hinge 105, a first lid hinge 106, a second lid hinge 107, a main seat exhaust 108, a first exhaust tube 109, a second exhaust tube 110, an end cap 111, and an elbow joint 112. The invention 100 is adapted to work with a toilet 131 as the toilet seat 101. The toilet seat 101 is adapted to be attached to an exhaust vent 133 such that air can be drawn through the toilet seat 101 and expelled through the exhaust vent 133.

The toilet seat 101 is a commercially available toilet seat that is modified such that the toilet seat 101 further comprises a plurality of ventilation holes 102 and one or more ventilation channels 103. The toilet seat 101 is further defined with an upper surface 121 and a lower surface 122. The lower surface 122 of the toilet seat 101 faces the toilet basin 132. The upper surface 121 of the toilet seat 101 is the surface distal from the lower surface 122. The plurality of ventilation holes 102 are formed in the lower surface 122 of the toilet seat 101. The plurality of ventilation holes 102 receive gases from the toilet basin 132 and routes the gases to the one or more ventilation channels 103. The one or more ventilation channels 103 route the gases collected from the plurality of ventilation holes 102 to the main seat exhaust 108. Gases collected by the main seat exhaust 108 are routed to the exhaust vent 133.

The apparatus that routes the collected gases comprises the first seat hinge 104, the second seat hinge 105, the first lid hinge 106, the second lid hinge 107, the main seat exhaust 108, the first exhaust tube 109, the second exhaust tube 110, the end cap 111, and the elbow joint 112.

The first seat hinge 104 further comprises a first end 163, a second end 164, a first tab 181, a second tab 182, and a first circular hole 116. The second seat hinge 105 further comprises a third end 175, a fourth end 176, a third tab 183, a fourth tab 184, and a second circular hole 117. The first lid hinge 106 further comprises a fifth end 165, a sixth end 166, a fifth tab 185, and a third circular hole 118. The second lid hinge 107 further comprises a seventh end 173, an eighth end 174, a sixth tab 186, and a fourth circular hole 119. The main seat exhaust 108 is a pipe that is further defined with a ninth end 169 and a tenth end 170. The first exhaust tube 109 is a pipe that is further comprises an eleventh end 167 and a twelfth end 168.

The second exhaust tube 110 is a pipe that further comprises a seventeenth end 171 and an eighteenth end 172. The end cap 111 is a capped pipe that further comprises a thirteenth end 177 and a fourteenth end 178. The fourteenth end 178 is the closed end of the end cap 111. The elbow joint 112 is a commercially available elbow joint that redirects the flow of gases through the invention 100.

The elbow joint is further defined with a fifteenth end 161 and a sixteenth end 162. The first circular hole 116 of the first seat hinge 104 is a structure in the form of a cylinder. The first tab 181 and the second tab 182 are arranged such that the position of the first tab 181 can be rotated around the first circular hole 116 to change the position of the first tab 181 relative to the second tab 182. The first circular hole 116 is sized such that the outer diameter of the first exhaust tube 109 is smaller than the inner diameter of the first circular hole 116. The second circular hole 117 of the second seat hinge 105 is a structure in the form of a cylinder.

The third tab 183 and the fourth tab 184 are arranged such that the position of the third tab 183 can be rotated around the second circular hole 117 to change the position of the third tab 183 relative to the fourth tab 184. The second circular hole 117 is sized such that the outer diameter of the second exhaust tube 110 is smaller than the inner diameter of the second circular hole 117. The third circular hole 118 of the first lid hinge 106 is a pipe that is sized such that the outer diameter of the first exhaust tube 109 is smaller than the inner diameter of the third circular hole 118. The fifth tab 185 projects away from the third circular hole 118. The fourth circular hole 119 of the second lid hinge 107 is a pipe sized such that the outer diameter of the second exhaust tube 110 is smaller than the inner diameter of the fourth circular hole 119. The sixth tab 186 projects away from the third circular hole 118. The outer diameter of the second exhaust tube 110 is smaller than the inner diameter of the thirteenth end 177 of the end cap 111. The outer diameter of the first exhaust tube 109 is smaller than the inner diameter of the second end 162 of the elbow joint 112.

To assemble the invention 100, the one or more ventilation channels 103 are connected to the main seat exhaust 108 such that gases can flow from the one or more ventilation channel 103 into the main seat exhaust 108. The twelfth end 168 of the first exhaust tube 109 is inserted into the ninth end 169 of the main seat exhaust 108. The seventeenth end 171 of the second exhaust tube 110 is inserted into the tenth end 170 of the main seat exhaust 108. The seventh end 173 of the fourth circular hole 119 of the second lid hinge 107 is slid over the eighteenth end 172 of the second exhaust tube 110. The third end 175 of the second circular hole 117 of the second seat hinge 105 is slid over the eighteenth end 172 of the second exhaust tube 110. The thirteenth end 177 of the end cap 111 is slid over the eighteenth end 172 of the second exhaust tube 110. The sixth end 166 of the third circular hole 118 is slid over the eleventh end 167 of the first exhaust tube 109. The second end 164 of the first circular hole 116 of the first seat hinge 104 is slid over the eleventh end 167 of the first exhaust tube 109. The sixteenth end 162 of the elbow joint 112 is slid over the eleventh end 167 of the first exhaust tube 109.

To attach the invention 100 to the toilet 131, the first tab 181 of the first seat hinge 104 is attached to the toilet 131. The second tab 182 is attached to the lower surface 122 of the toilet seat 101. The third tab 183 of the second seat hinge 105 is attached to the toilet 131. The fourth tab 184 of the second seat hinge 105 is attached to the lower surface 122 of the toilet seat 101. Attaching the first seat hinge 104 and the second seat hinge 105 to the toilet 131 is adequate to attach the invention 100 to the toilet 131 in such a manner that the toilet seat 101 can be raised or lowered by rotating the toilet seat 101 using the first seat hinge 104 and the second seat hinge 105 as a pivot point.

To attach the toilet lid 134 to the invention 100, the fifth tab 185 of the first lid hinge 106 is attached to the toilet lid 134 and the sixth tab 186 of the second lid hinge 107 is attached to the toilet lid 134. With this construction, the first lid hinge 106 and the second lid hinge 107 rotate around the first exhaust tube 109 and the second exhaust tube 110 respectively to allow the toilet lid 134 to be raised and lowered.

The fifteenth end 161 of the elbow joint 112 is connected to an exhaust vent 133 using an exhaust pipe 135. The exhaust pipe 135 is beyond the scope of the claims in this disclosure. It is preferred that the exhaust vent 133 incorporate a fan such that gases can be drawn from the toilet basin 132 into and through the invention 100 such that the gases are expelled from the exhaust vent 133.

After installation, the invention 100 is used as a regular toilet seat 101. The toilet seat 101 and the main seat exhaust are formed from molded plastic. Suitable plastics include, but are not limited to, high density polyethylene or polyvinylchloride. The remaining components can be adapted from commercially available parts.

The following definitions were used in this disclosure:

Capped Pipe: As used in this disclosure, a capped pipe is a pipe with one closed end and one open end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; or, 4) the point, pivot, or axis around which something revolves.

Center Axis: As used in this disclosure, the center axis is the axis of a cylinder like structure. When the center axes of two cylinder like structures share the same line they are said to be aligned. When the center axes of two cylinder like structures do not share the same line they are said to be offset.

Hinge: As used in this disclosure, a hinge is a device that permits the turning, rotating, or pivoting of a first object relative to a second object.

Inner Diameter: As used in this disclosure, the term inner diameter is used in the same way that a plumber would refer to the inner diameter of a pipe.

Outer Diameter: As used in this disclosure, the term outer diameter is used in the same way that a plumber would refer to the outer diameter of a pipe.

Pipe: As used in this disclosure, a pipe is a hollow cylindrical device that is used for transporting liquids and gasses. The line that connects the center of the first base of the cylinder to the center of the second base of the cylinder is referred to as the axis of the cylinder or the centerline of the pipe. When two pipes share the same centerline they are said to be aligned. In this disclosure, the terms inner diameter of a pipe and outer diameter are used as they would be used by those skilled in the plumbing arts.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A ventilation apparatus comprising:

a toilet seat, a plurality of ventilation holes, one or more ventilation channels, a first seat hinge, a second seat hinge, a first lid hinge, a second lid hinge, a main seat exhaust, a first exhaust tube, a second exhaust tube, an end cap, and an elbow joint;

wherein the ventilation apparatus is adapted to be used with a toilet;

wherein the ventilation apparatus is adapted to be attached to an exhaust vent;

wherein the ventilation apparatus is designed to replace the toilet seat of a toilet;

wherein the toilet seat further comprises the plurality of ventilation holes and the one or more ventilation channels;

wherein the toilet seat is further defined with an upper surface and a lower surface;

wherein the plurality of ventilation holes are formed in the lower surface of the toilet seat;

wherein the gases collected by the plurality of ventilation holes is routed through the one or more ventilation channels to the main seat exhaust;

wherein the main seat exhaust, the first exhaust tube, the second exhaust tube, the end cap, and the elbow joint route the gases collected by the main seat exhaust to the exhaust vent;

wherein the first seat hinge further comprises a first end, a second end, a first tab, a second tab, and a first circular hole;

wherein the second seat hinge further comprises a third end, a fourth end, a third tab, a fourth tab, and a second circular hole;

wherein the first lid hinge further comprises a fifth end, a sixth end, a fifth tab, and a third circular hole;

wherein the second lid hinge further comprises a seventh end, an eight end, a sixth tab, and a fourth circular hole;

wherein the main seat exhaust is a pipe that is further defined with a ninth end and a tenth end;

wherein the first exhaust tube is a pipe that is further comprises an eleventh end and a twelfth end;

the second exhaust tube is a pipe that further comprises an eleventh end and a twelfth end.

2. The ventilation apparatus according to claim 1 wherein wherein the end cap is a capped pipe that further comprises a thirteenth end and a fourteenth end;

elbow joint is further defined with a fifteenth end and a sixteenth end.

3. The ventilation apparatus according to claim 2 wherein the first circular hole of the first seat hinge is a structure in the form of a cylinder;

wherein the first tab and the second tab are arranged such that the position of the first tab can be rotated around the first circular hole to change the position of the first tab relative to the second tab;

wherein the first circular hole is sized such that the outer diameter of the first exhaust tube is smaller than the inner diameter of the first circular hole;

wherein the second circular hole of the second seat hinge is a structure in the form of a cylinder;

wherein the third tab and the fourth tab are arranged such that the position of the third tab can be rotated around the second circular hole to change the position of the third tab relative to the fourth tab;

wherein the second circular hole is sized such that the outer diameter of the second exhaust tube is smaller than the inner diameter of the second circular hole.

4. The ventilation apparatus according to claim 3 wherein the third circular hole of the first lid hinge is a pipe that is sized such that the outer diameter of the first exhaust tube is smaller than the inner diameter of the third circular hole;

wherein the fifth tab projects away from the third circular hole;

wherein the fourth circular hole of the second lid hinge is a pipe sized such that the outer diameter of the second exhaust tube is smaller than the inner diameter of the fourth circular hole;

wherein the sixth tab projects away from the third circular hole.

5. The ventilation apparatus according to claim 4 wherein the outer diameter of the second exhaust tube is smaller than the inner diameter of the thirteenth end of the end cap;

wherein the outer diameter of the first exhaust tube is smaller than the inner diameter of the sixteenth end of the elbow joint.

6. The ventilation apparatus according to claim 5 wherein the one or more ventilation channels are connected to the main seat exhaust.

7. The ventilation apparatus according to claim 6 wherein the twelfth end of the first exhaust tube is inserted into the ninth end of the main seat exhaust;

wherein a seventeenth end of the second exhaust tube is inserted into the tenth end of the main seat exhaust.

8. The ventilation apparatus according to claim 7 wherein the seventh end of the fourth circular hole of the second lid hinge is slid over an eighteenth end of the second exhaust tube;

wherein the third end of the second circular hole of the second seat hinge is slid over the eighteenth end of the second exhaust tube;

wherein the thirteenth end of the end cap is slid over the eighteenth end of the second exhaust tube.

9. The ventilation apparatus according to claim 8 wherein the sixth end of the third circular hole is slid over the eleventh end of the first exhaust tube;

wherein the second end of the first circular hole of the first seat hinge is slid over the eleventh end of the first exhaust tube;

wherein the sixteenth end of the elbow joint is slid over the eleventh end of the first exhaust tube.

10. The ventilation apparatus according to claim 9 wherein the first tab of the first seat hinge is attached to the toilet;

wherein the second tab is attached to the lower surface of the toilet seat;

wherein the third tab of the second seat hinge is attached to the toilet;

wherein the fourth tab of the second seat hinge is attached to the lower surface of the toilet seat.

11. The ventilation apparatus according to claim 10 wherein the fifth tab of the first lid hinge is attached to the toilet lid;

wherein the sixth tab of the second lid hinge is attached to the toilet lid.

12. The ventilation apparatus according to claim 11 wherein the fifteenth end of the elbow joint is connected to an exhaust vent using an exhaust pipe.

* * * * *